US005179816A

United States Patent [19]

Wojnicki

[11] Patent Number: 5,179,816

[45] Date of Patent: Jan. 19, 1993

[54] APPARATUS FOR AUTOMATICALLY FORMING, FILLING, SEALING AND SEPARATING FILM PACKAGING FROM A FILM WEBBING

[76] Inventor: John Wojnicki, 10 Millstone Dr., Cranbury, N.J. 08512

[21] Appl. No.: 790,967

[22] Filed: Nov. 12, 1991

[51] Int. Cl.[5] ..... B65B 43/04; B65B 43/30; B65B 61/18

[52] U.S. Cl. ..... 53/133.4; 53/138.1; 53/562; 53/570; 53/384.1

[58] Field of Search ..... 53/412, 416, 455, 133.4, 53/138.1, 468, 562, 567, 570, 459, 469, 384.1

[56] References Cited

U.S. PATENT DOCUMENTS

| | | | |
|---|---|---|---|
| 2,159,858 | 5/1939 | Neuman et al. . | |
| 2,322,090 | 6/1943 | Hobbie . | |
| 2,671,585 | 3/1954 | Kindseth . | |
| 2,852,045 | 9/1958 | Goodner . | |
| 2,890,006 | 6/1959 | Hopkins . | |
| 3,462,913 | 8/1969 | Bodolay et al. | 53/562 |
| 3,540,497 | 11/1970 | Troyer . | |
| 3,618,286 | 11/1971 | Membrino | 53/570 |
| 3,699,746 | 10/1972 | Titchenal et al. | 53/570 |
| 3,700,388 | 10/1972 | Johnson et al. | 53/562 |
| 3,709,449 | 1/1973 | Martin et al. . | |
| 3,744,211 | 7/1973 | Titchenal et al. | 53/570 X |
| 3,753,332 | 8/1973 | Membrino | 53/567 |
| 3,785,410 | 1/1974 | Carter . | |
| 4,169,345 | 10/1979 | Douwenga . | |
| 4,441,304 | 4/1984 | Douwenga . | |
| 4,514,962 | 5/1985 | Ausnit | 53/570 X |
| 4,519,426 | 5/1985 | Hardy . | |
| 4,548,018 | 10/1985 | Wojnicki . | |
| 4,572,251 | 2/1986 | Drury . | |
| 4,586,319 | 5/1986 | Ausnit | 53/468 |
| 4,665,552 | 5/1987 | Lems et al. | 53/570 X |
| 4,709,533 | 12/1987 | Ausnit | 53/133.4 X |
| 4,798,041 | 1/1989 | Bentsen | 53/468 |
| 4,848,064 | 7/1989 | Lems et al. | 53/570 X |
| 4,894,975 | 1/1990 | Ausnit | 53/412 |
| 4,945,714 | 8/1990 | Bodolay et al. | 53/562 X |
| 5,036,643 | 8/1991 | Bodolay | 53/562 X |

*Primary Examiner*—Horace M. Culver
*Attorney, Agent, or Firm*—Sperry, Zoda & Kane

[57] ABSTRACT

An apparatus for forming film packaging from a webbing of film which also fills, seals and separates the packaging which includes a housing with a film supply means located adjacent the upstream end thereof to supply film webbing for support upon a longitudinally extending support bar mounted within the housing. The support carries the film webbing to a side sealing station and a side cutting station for forming the individual packages as well as a top slitting station for forming an opening in the uppermost portion of the webbing to facilitate bottom loading of product therein. The webbing is then transported to a loading station where the webbing is clamped by an upstream film clamping device and a downstream film clamping device and wherein the opening is made open by a first and second pouch opening clamping device oriented obliquely angularly with respect to the path of movement of the film webbing therealong.

20 Claims, 3 Drawing Sheets

APPARATUS FOR AUTOMATICALLY FORMING, FILLING, SEALING AND SEPARATING FILM PACKAGING FROM A FILM WEBBING

BACKGROUND OF THE INVENTION

1.Field of the Invention

The present invention is related to the field of form, fill, seal and separate packaging machines normally used in the packaging industry with resealable and plain pouches. Such packaging machines are usable to receive a webbing normally made of a plastic material such as, for example, polyethylene, which is then formed into individual packages and filled with the product all within the housing of the machine The web is transported through the machine to facilitate the individual forming, filling and exiting of the packages.

2. Description of the Prior Art

Flexible packaging has seen major advances in recent years by the introduction of resealable zipper-type plastic bags for retailing of various products especially in the consumer field Most recently these types of packaging have been introduced into the marketing of food products which has greatly expanded utility of resealable plastic packaging.

Many types of systems and machines and methods have been patented for the processing of film webbing into film packaging such as shown in U.S. Pat. No. 2,159,858 patented May 23, 1939 to J. Neuman et al on a Bag Filling Device; U.S. Pat. No. 2,322,090 patented Jun. 15, 1943 to A. Hobbie on a Bag Filling Apparatus; U.S. Pat. No. 2,671,585 patented Mar. 9, 1954 to H. Kindseth on a Bag Filling Machine With Slidably Mounted Bag Clamping Means; U.S. Pat. No. 2,852,045 patented Sep. 16, 1958 to J. Goodner on a Bag Holder; U.S. Pat. No. 2,890,006 patented Jun. 9, 1959 to F. Hopkins on a Bag Holding Device For Filling Machine; U.S. Pat. No. 3,462,913 patented Aug. 26, 1969 to J. Bodolay et al on a Combination Multiple Bag Making And Compartment Bag Making Machine; U.S. Pat. No. 3,540,497 patented Nov. 17, 1970 to A. Troyer on a Bag Holding Mechanism For Bagging Machine; U.S. Pat. No. 3,618,286 patented Nov. 9, 1971 to H. Membrino on a Bag Filling, Sealing And Separating System; U.S. Pat. No. 3,699,746 patented Oct. 24, 1972 to O. Titchenal et al on an Apparatus For Filling A Chain Of Connected Bag Elements; U.S. Pat. No. 3,709,449 patented Jan. 9, 1973 to W. Martin et al on a Bag Holding Apparatus; U.S. Pat. No. 3,785,410 patented Jan. 15, 1974 to C. Carter on a Method And Apparatus For Vacuum Filling Open Mouth Bags; U.S. Pat. No. 4,169,345 patented Oct. 2, 1979 to R. Douwenga on a Device For Opening Out The Filling Apertures Of Bags; U.S. Pat. No. 4,441,304 patented Apr. 10, 1984 to R. Douwenga on an Apparatus For Opening Out The Filling Openings Of Bags Of Foil Material Or The Like Which Are Connected Together In The Manner Of A Band; U.S. Pat. No. 4,519,426 patented May 28, 1985 to D. Hardy, Jr. on an Apparatus For Filling A Lined, Semibulk Container; U.S. Pat. No. 4,548,018 patented Oct. 22, 1985 to J. Wojnicki on an Apparatus For Horizontally Forming, Filling And Sealing Film Pouch Material; U.S. Pat. No. 4,572,251 patented Feb. 25, 1986 to G. Drury on a Pneumatic Bagger Ring; U.S. Pat. No. 4,586,319 patented May 6, 1986 to S. Ausnit on a Method Of And Means For Easy Opening Bags; U.S. Pat. No. 4,945,714 patented Aug. 7, 1990 to W. Bodolay et al on a Form, Fill, Seal And Separate Packaging Machine For Reclosable Containers and U.S. Pat. No. 5,036,643 patented Aug. 6, 1991 to W. Bodolay on a Form, Fill, Seal And Separate Packaging Machine For Reclosable Containers Including Means For Applying Zipper To Web.

SUMMARY OF THE INVENTION

The present invention provides an apparatus for automatically forming, filling, sealing and separating film packaging from a film webbing which includes a housing defining an upstream end and a downstream end thereof. A film supply device is positioned adjacent the upstream end of the housing to provide a continuous supply of film webbing thereto. Preferably the film supply means will comprise a roller of continuously feedable fill material wherein the roller may be oriented with its axis extending horizontally or vertically with respect to the housing.

A longitudinal support bar may be mounted within the housing such as to receive the film webbing from the film supply means for support thereon in a vertically extending orientation. The longitudinal support bar is adapted to abut the film at an intermediate position thereunder being approximately in the center thereof such that portions of the film webbing are allowed to drape downwardly on both sides of the longitudinal support bar. The film webbing is moved to a side sealing station for forming a vertically extending side seal and is movable to a side cutting station for vertically cutting of the film adjacent the side seals to form individual packaging. To facilitate guiding of the film webbing from the roll onto the support bar a plurality of guide rollers may be included for maintaining tension and to maintain proper orientation of the film while supported by the support bar.

A slit is then cut into the top of the film to facilitate bottom loading thereof. The loading occurs at a loading station. The loading station preferably includes an upstream film clamp and a downstream film clamp adapted to fix an individual package in place to facilitate loading thereof. The downstream film clamp is movable longitudinally with respect to the film webbing between a loading station at the downstreammost position and a pre-loading station at the upstreammost position. By movement of the downstream film clamp in an upstream direction toward the upstream film clamp sufficient slack will be provided therebetween to allow a first and second pouch opening device to clamp upon the two top edges of the pouch and to move outwardly for opening of the top opening thereof to facilitate loading. The loading will occur at this same station from a filling device located thereabove. The pouch opening devices each include a gripping means for grasping the top edges of the pouch and are oriented at an oblique angle with respect to the direction of movement of the film webbing to facilitate equalization of the slack created by movement of the downstream film clamp from the pre-loading position to the loading position. After filling a sealing device will seal the two top pouch edges together for sealing of the bottom of the pouch while in the filled condition. A cutting means will then be adapted to cut the so-formed package from the film webbing and allow movement to the discharge device for expelling of the finally formed package from the housing.

With the above-described apparatus the webbing will usually be generally tubular and include the resealable zipper closing means already fixedly secured to the lower portion thereof while wound upon the film supply roller. An alternative configuration includes merely a film sheeting supplied by a film supply device or film supply roller with a separate resealable zipper material being supplied through a separate roller. This configuration is normally used with laminated material whereas the above-described invention is normally utilized with plastic material such as polyethylene.

In the alternative configuration the resealable zipper supply roller and the film webbing material will both be supplied on rollers preferably oriented with the rotational axis thereof extending in a horizontal direction with respect to the housing. A folding means will fold the film webbing material downwardly such that it drapes down along both outward sides of the film support bar. A zipper attachment device will be included to seal the zipper material with respect to the film webbing or sheeting to thereby provide the resealable packaging which is supplied on a single roll when utilizing the apparatus of the plastic material described above.

It is an object of the present invention to provide an apparatus for automatically forming, filling, sealing and separating film packaging from a film webbing wherein use with a plastic film webbing or a laminated film webbing is possible.

It is an object of the present invention to provide an apparatus for automatically forming, filling, sealing and separating film packaging from a film webbing wherein a separate resealable zipper material can be secured as desired with respect to a laminated film webbing.

It is an object of the present invention to provide an apparatus for automatically forming, filling, sealing and separating film packaging from a film webbing wherein a longitudinally extending support bar is adapted to support the film webbing material during processing thereon.

It is an object of the present invention to provide an apparatus for automatically forming, filling, sealing and separating film packaging from a film webbing wherein a side sealing and side cutting station can be formed as separate or within a single station.

It is an object of the present invention to provide an apparatus for automatically forming, filling, sealing and separating film packaging from a film webbing wherein pouch opening means for opening the filling opening in the top portion of the individually formed package are oriented obliquely with respect to the direction of movement of the film webbing.

It is an object of the present invention to provide an apparatus for automatically forming, filling, sealing and separating film packaging from a film webbing wherein tracking rollers may be utilized to correctly orient the film webbing upon the longitudinal support bar.

It is an object of the present invention to provide an apparatus for automatically forming, filling, sealing and separating film packaging from a film webbing wherein filling, sealing, separating and dispensing of the filled packaging is all achieved at a single location.

It is an object of the present invention to provide an apparatus for automatically forming, filling, sealing and separating film packaging from a film webbing wherein initial capital outlay for equipment is minimized.

It is an object of the present invention to provide an apparatus for automatically forming, filling, sealing and separating film packaging from a film webbing wherein maintenance costs are minimized.

It is an object of the present invention to provide an apparatus for automatically forming, filling, sealing and separating film packaging from a film webbing wherein equipment down time is minimized.

It is an object of the present invention to provide an apparatus for automatically forming, filling, sealing and separating film packaging from a film webbing wherein filling can be achieved for a great variety of different types of materials.

It is an object of the present invention to provide an apparatus for automatically forming, filling, sealing and separating film packaging from a film webbing wherein movement of the clamping means just prior to filling provides sufficient slack distributed along the entire length of the filling opening to allow complete opening to facilitate filling therethrough.

It is an object of the present invention to provide an apparatus for automatically forming, filling, sealing and separating film packaging from a film webbing wherein film may be supplied by a power unwinding roll.

It is an object of the present invention to provide an apparatus for automatically forming, filling, sealing and separating film packaging from a film webbing wherein final sealing is achieved immediately at the loading station.

It is an object of the present invention to provide an apparatus for automatically forming, filling, sealing and separating film packaging from a film webbing wherein no belt or pins or other additional moving parts are required in order to achieve full and accurate control of movement of the webbing and proper processing thereon.

It is an object of the present invention to provide an apparatus for automatically forming, filling, sealing and separating film packaging from a film webbing wherein a side sealing station can be utilized to draw the film webbing through the apparatus.

It is an object of the present invention to provide an apparatus for automatically forming, filling, sealing and separating film packaging from a film webbing wherein speed of processing is greatly enhanced and wherein gravity insertion is usable therewith.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
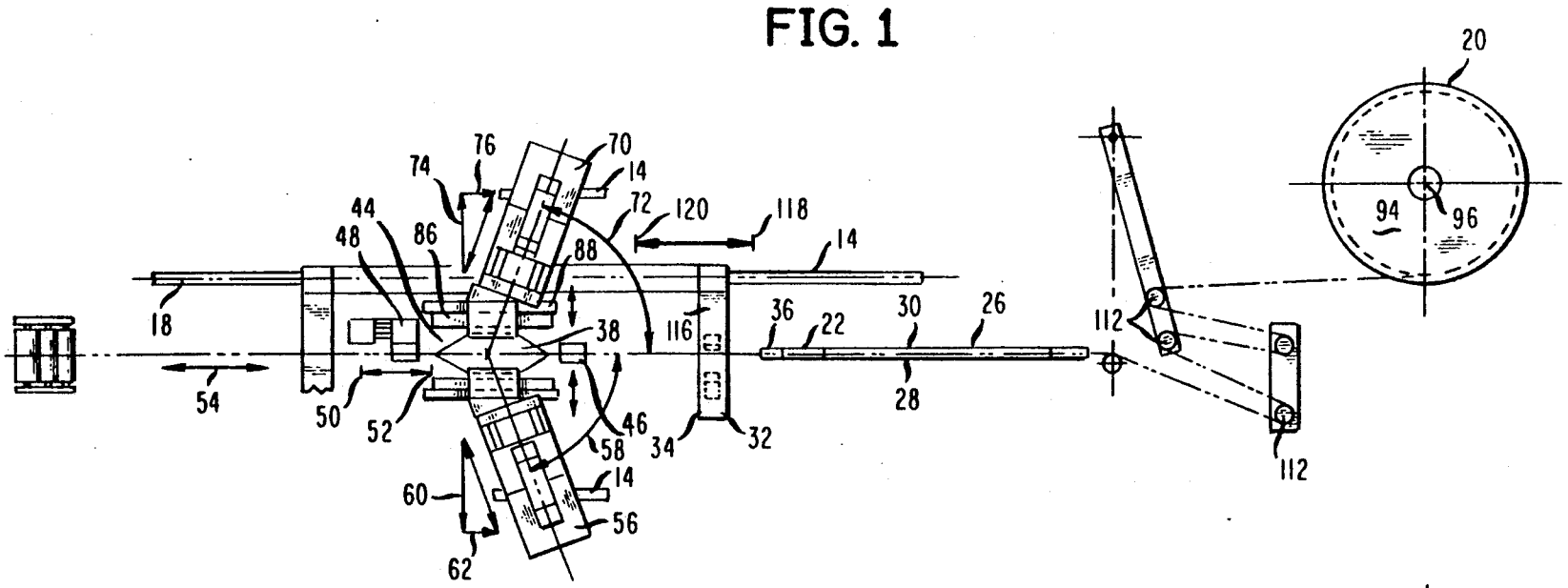
FIG. 1 is a top plan view of an embodiment of the present invention.
Figure 2:
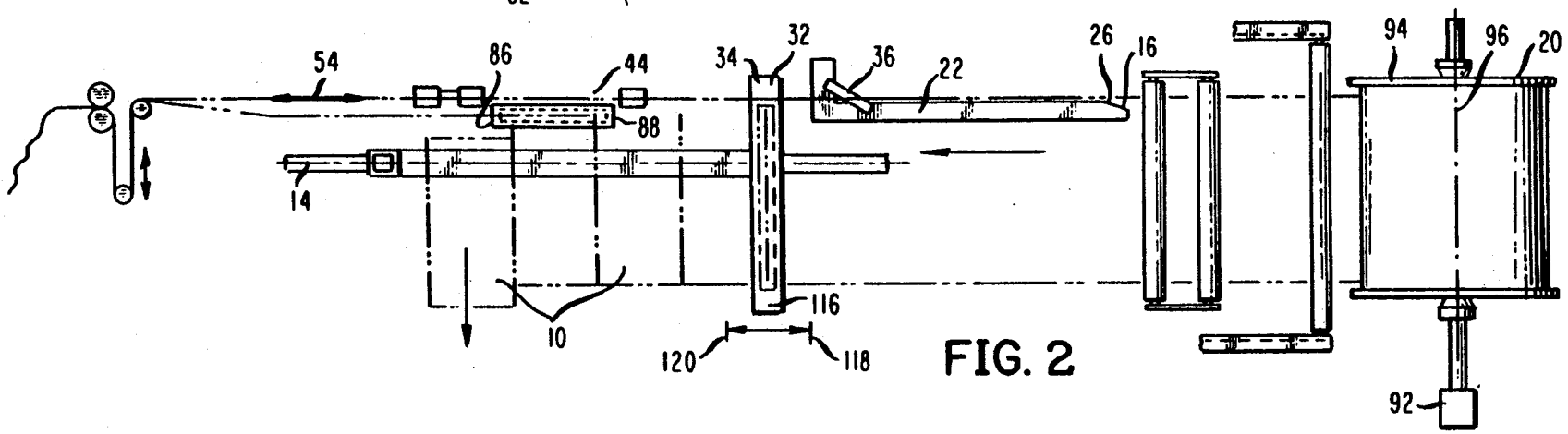
FIG. 2 is a side plan view of the embodiment shown in FIG. 1.

The present invention provides an apparatus for automatically forming, filling, sealing and separating film packages 10 from a raw film webbing 12. The apparatus includes a housing 14 which defines an upstream end 16 and a downstream end 18 thereon. Upstream end 16 is positioned adjacent to a film supply means 20 which may take the form of a roll as shown best in FIG. 1. The film webbing 12 wound continuously upon the film supply roll 20 is adapted to pass through a plurality of guide rollers 112 for guiding into the upstream end 16 of housing 14 and onto the longitudinally extending support bar 22. Preferably the film webbing 12 is supported at an intermediate position 24 thereon such as to allow a portion of the film webbing 12 to extend downwardly along both the first side 28 and the second side 30 of the longitudinally extending support bar 22. The supporting relationship of the support bar 22 with respect to the intermediate position 24 of the film webbing 12 is provided by the top edge 26 thereof.

Figure 4:
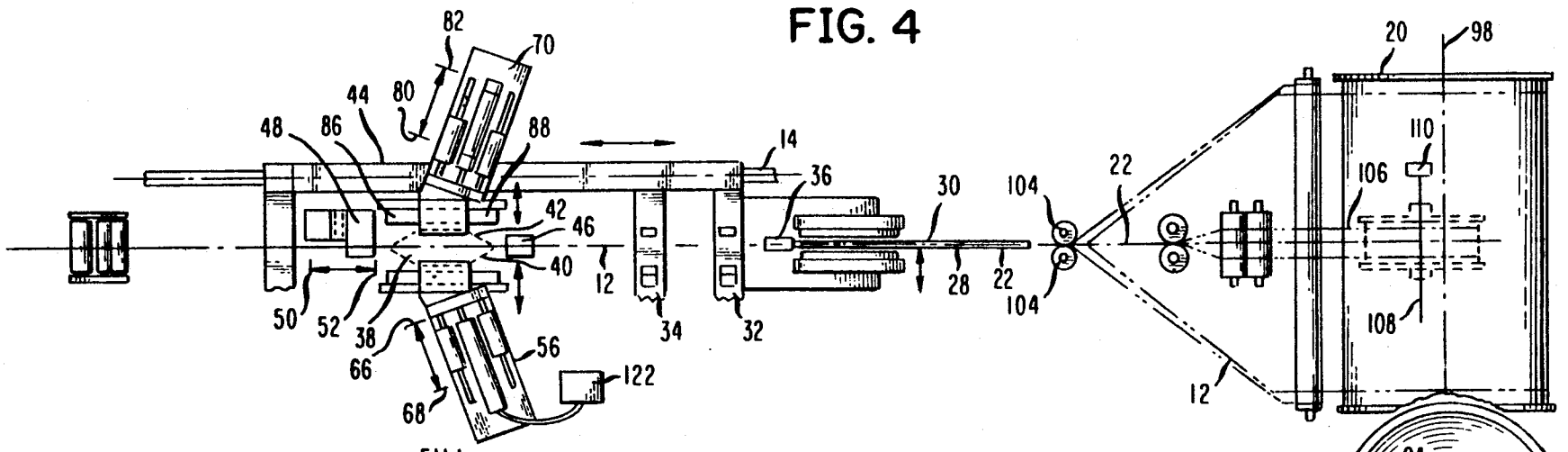
FIG. 4 is a top plan view of an alternative embodiment of the present invention.
Figure 5:
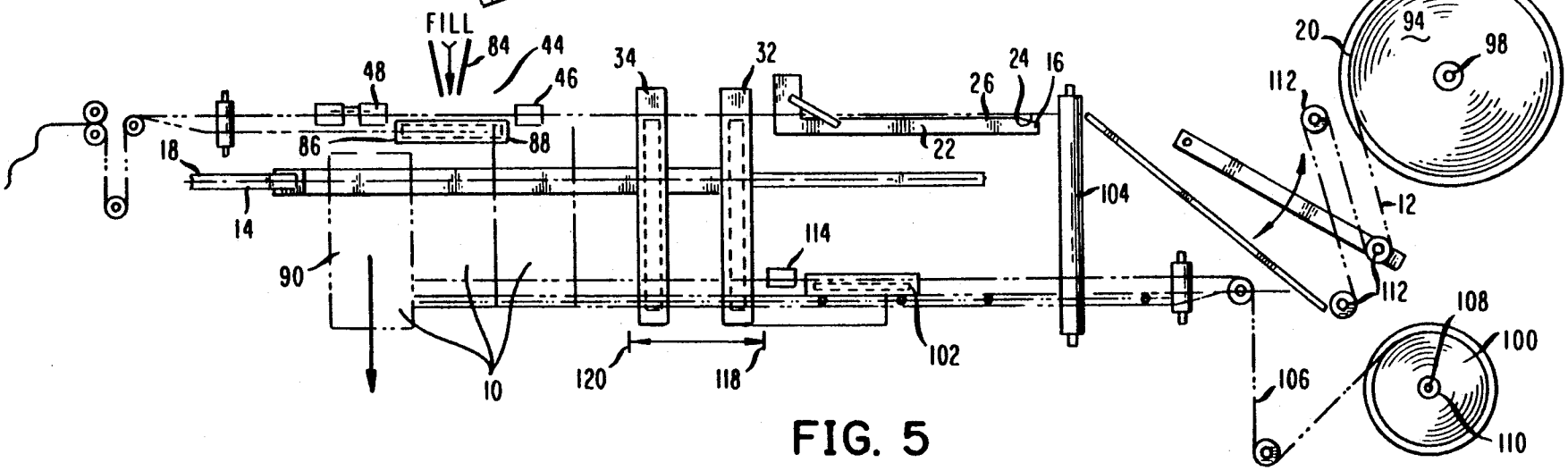
FIG. 5 is a side plan view of the alternative embodiment of the present invention shown in FIG. 4.

Film webbing 12 is then supported and carried to the side sealing station 32 wherein vertically extending side seals are formed therein. A side cutting means 34 which may be a separate station as shown in FIGS. 4 and 5 or may be performed at the same station as the side sealing means 32 is then operable to cut in between adjacent seals to facilitate formation of the individual film packages 10 connected by the uncut section at the top. Before side cutting and sealing a top slitting means 36 is adapted to make a cut in the uppermost portion of the film which is actually the bottom thereof since the package is now in the inverted position with the resealable zipper in the lowermost section. This upper opening is defined as the top pouch opening 38 through which filling of the package will be achieved. Top pouch opening 38 is defined by a first top pouch edge 40 and a second top pouch edge 42.

The film webbing with the individually formed packages and the top pouch opening 38 therein can now be transported to a loading station 44. Movement of the film webbing throughout the apparatus of the present invention is achieved by the various clamping means such as the side sealing means 32 which is adapted to draw the film webbing along the longitudinally extending support bar 22. At the loading station 44 the movement of the film loading webbing will be halted to allow clamping adjacent the individual package to be loaded by the upstream film clamping means 46 and the downstream film clamping means 48. At the moment of clamping the downstream film clamping means 48 will be in the pre-loaded position 50. After clamping is achieved the first pouch opening means 56 will be position adjacent the first top pouch edge 40. The first pouch opening means 56 defines a first gripping means 64 which will be adapted to grip the first top pouch edge 40. In a similar manner the second pouch opening means 70 which includes a second gripping means 78 will be positioned adjacent the second top pouch edge 42 of the film webbing 12 to facilitate gripping thereof. In this position the first gripping means 64 will be in the first closed position 66 and the second gripping means 78 of the second pouch opening means 70 will be in the second closed position 80.

As the downstream film clamping means 48 moves from the pre-loading position 50 to the loading position 52 along the longitudinal direction 54 of the film webbing 12 slack will be created in the film webbing 12 between the downstream film clamping means 48 and the first gripping means 64 or the second gripping means 78. All of this slack will occur downstream from the first pouch opening means 56 and the second pouch opening means 70 since the first and second gripping means 64 and 78 thereof, respectively, are maintaining an intermediate grip on the film webbing 12 at a position in the approximate middle of the top pouch opening 38.

This slack of film webbing material 12 is needed in order to allow outward movement of the first top pouch edge 40 and the second top pouch edge 42 to allow opening of the top pouch opening 38 such that filling can be performed therethrough.

In order to distribute this slack to the entire longitudinal length of the top pouch opening 38 it is desirable to position the first pouch opening means 56 at an oblique angle 58 with respect to the longitudinal direction 54 of movement of the film webbing 12. In a similar manner it is necessary to orient the second pouch opening means 70 at an oblique angle 72 with respect to the longitudinal direction 54 of movement of the film webbing 12.

With this configuration the first pouch opening means 56 and in particular first gripping means 64 thereof will be movable to a first opened position 68 located outwardly and upstream with respect to the first closed position 66. In a similar manner the second pouch opening means 70 and in particular the second gripping means 78 will be movable from the second closed position 80 to the second opened position 82 which will include some movement in both the outward and upstream direction to facilitate equalizing of the slack along the top pouch opening 38.

Figure 3:
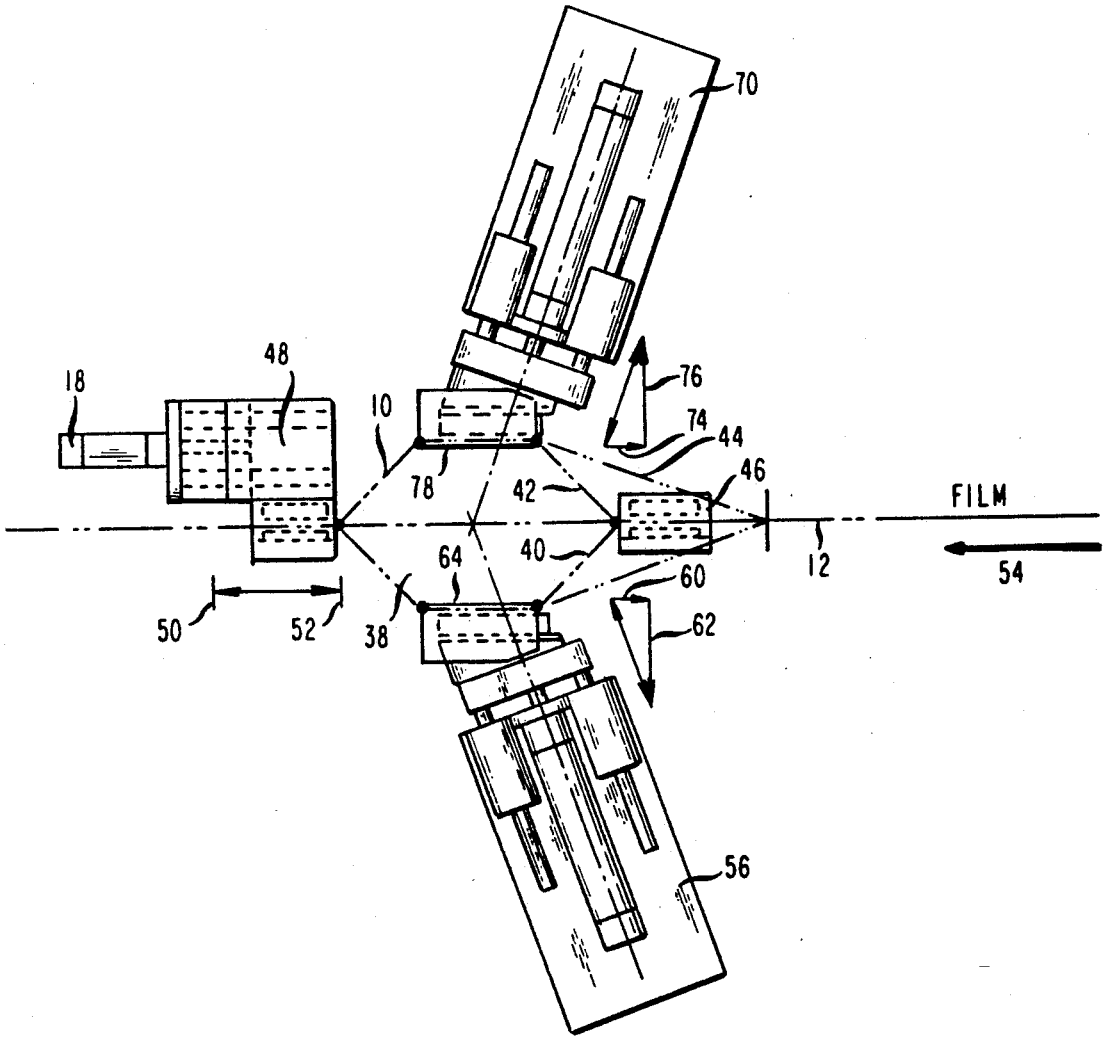
FIG. 3 is a top plan view closeup of the loading station of the embodiment shown in FIG. 1.

As seen best in FIGS. 1, 3 and 4 the movement of the first pouch opening means 56 and in particular the first gripping means 64 thereof from the first closed position 66 to the first opened position 68 will include a component of movement outwardly shown by outwardly direction arrow 60 as well as a component of direction upstream as shown by upstream arrow 62. This oblique angle 58 of movement between the first gripping means 64 and the longitudinal direction 54 of film webbing 12 will allow equalizing of the slack created by the downstream film clamping means 48 to be equally distributed along the top pouch opening 38.

In a similar manner the second pouch opening means 70 and in particular the second gripping means 78 thereof when moving from the second closed position 80 to the second opened position 82 will include a component of movement in the outward direction shown by outwardly directed arrow 74 as well as in the upstream direction shown by upstream arrow 76. The upstream component of this movement will further aid in the equal distribution of the slack formed by downstream film clamping means 48 equally along the top pouch opening 38.

With both the first pouch opening means 56 and the second pouch opening means 70 positioned in the first opened position 68 and the second opened position 82, respectively, the filling means 84 will be operated to preferably gravity feed materials through the top pouch opening 38. Thereafter the sealing means 86 will be operable to seal the top pouch opening 38 by sealing the first top pouch edge 40 and the second top pouch edge 42 with respect to one another. The formed package will be cut from the film webbing by the cutting means 88 and will pass to discharge means 90 which will aid in discharging and collecting of the finally formed packages.

With the apparatus of the present invention it is preferable to power the supply of film webbing 12 from the film supply means 20 and as such a film drive means 92 may be included. Preferably film drive means 92 is operatively connected with respect to the film supply roller 94. Film supply roller 94 can be oriented with the rotational axis thereof oriented in a vertical direction such as shown at axis 96. Alternatively, as shown in FIG. 4, the rotational axis of the film supply roller 94 can be oriented in a horizontally extending direction as shown by axis 98.

The preferable configuration for the use of the apparatus of the present invention with laminated materials includes a resealable zipper supply means such as roller 100 which is adapted to supply resealable zipper material 106 to a zipper attachment means 102 shown best in FIGS. 4 and 5. The zipper supply roller 100 will be rotatable about a zipper supply roller axis 108 and can be powered by a zipper drive means 110.

In the configuration shown in FIGS. 4 and 5 it is preferable that the film webbing material 12 be provided from a film supply roller 94 having the rotational axis thereof oriented in the horizontal direction as shown at axis 98. With this configuration the material will be supplied to a folding means 104 with rollers which is adapted to fold the material downwardly along both sides of the longitudinally extending support bar 22 in such a manner as to facilitate adding of the resealable zipper material to the lowermost edges thereof.

The side sealing and cutting means 116 preferably is formed as a single station with both the side sealing means 32 and the side cutting means 34 configured as a single station 116. This is the preferable configuration when utilizing plastic film webbing material such as polypropylene or polyethylene.

In both of the embodiments of the present invention it is preferable to include a pneumatic power means 122 for powering operational movement of the various clamping means and in particular the first gripping means 64 of first pouch opening means 56 and the second gripping means 78 of the second pouch opening means 70.

The movement and orientation of the film webbing 12 while positioned upon the longitudinally extending support bar 22 can be accurately controlled by a plurality of tracking rollers 114 adapted to track the material and in particular to track the resealable zipper fixedly sealed with respect to the film webbing 12 in such a manner as to maintain the material in a taut secure suspended position with respect to the longitudinal support bar 22. Powering of movement of this film webbing material along the support bar 22 can be enhanced by the side sealing means 32 being also adapted to grip the material to urge longitudinal movement thereof in the downstream direction. Preferably the side sealing means 32 is movable from a first sealing position 118 to a second sealing position 120 in order to power movement of the film webbing 12 in the longitudinally extending direction 54. The side sealing means 32 can then return from the second sealing position 120 to the first sealing position 118 to facilitate recycling movement thereof.

In operation the apparatus as shown in FIG. 1 powers the film drive means 92 for power unwinding of the film webbing 12. Webbing 12 passes over the guide rollers 112 to the longitudinally extending support bar 22. The top slitting means 36 cuts a slit in the uppermost portion of the film web. The side sealing and cutting means 116 is movable between a first sealing position 118 and a second sealing position 120 to draw the film webbing 12 along the support bar 22 for providing of the webbing 12 to the first upstream clamping means 46 and the first downstream clamping means 48. With the downstream clamping means 48 in the most downstream position shown as the pre-loading position 50 the first pouch opening means 56 and the second pouch opening means 70 will be adapted to grip the first top pouch edge 40 and the second top pouch edge 42 respectively. With the first gripping means 64, second gripping means 78, upstream film clamping means 46 and downstream film clamping 48 all in gripping engagement with respect to the film webbing 12, the downstream film clamping means 48 will be moved from the pre-loading position 50 to the loading position 52. At this point the first pouch opening means 56 and second pouch opening means 70 will move from their respective closed positions to their respective opened positions to facilitate opening of the top pouch opening 38.

Filling can then be achieved by operation of a gravity feed means 84 or a conventional power filling means for down loading of materials through the top pouch opening 38. The formed packaging material can then be passed to the sealing means 86 and the cutting means 88 and finally to the discharge means 90.

The configuration shown in FIGS. 4 and 5 is similar to the apparatus of the FIG. 1 design however the orientation of the film webbing 12 is already horizontal since that film webbing will most likely not include an integral resealable zipper member therein. The rear sealable zipper member will be provided on the separate resealable zipper supply roller 100. The section of the film including the seal may be notched out to reduce the zipper profile for facilitating integrity of sealing. The zipper material 106 will be sealed to the lowermost edges of the film webbing 12 at the zipper attachment means 102. With this configuration it is preferable that the horizontally supplied film webbing will be passed to a folding means 104 which will be adapted to down fold the raw film webbing along both downwardly extending sides 28 and 30 of the support bar 22. Also, it is preferable with the configuration shown in FIGS. 4 and 5 that the side sealing means 32 and the side cutting means 34 be positioned at separate locations to facilitate the formation of a wider side seal with a cut oriented in an intermediate position within that seal.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for automatically forming, filling, sealing and separating film packaging from a film webbing comprising:

a. a housing means including an upstream end thereof for receiving of the film webbing and a downstream end thereof;

b. a film supply means positioned adjacent said upstream end of said housing means for providing a continuous supply of film webbing thereto;

c. a longitudinal support bar mounted with respect to said housing means and adapted to receive film webbing from said film supply means for support thereon in a vertically extending orientation, said longitudinal support bar adapted to abut the film webbing at an intermediate position thereunder and allow portions of the film webbing to extend downwardly on both sides of said longitudinal support bar;

d. a side sealing means adapted to grip the film webbing and form vertically extending side seals therein;

e. a side cutting means for vertically cutting of the film webbing adjacent the side seals formed therein by said side sealing means;

f. a top slitting means adapted to cut an opening in the film webbing adjacent the top edge thereof to form a first top pouch edge and second pouch edge and a top pouch opening therebetween for each individual packaging;

g. a loading station adapted to fill the packaging comprising:

1. an upstream film clamping means adapted to clamp the film webbing prior to filling thereof;

2. a downstream film clamping means located downstream with respect to said upstream film clamping means and adapted to clamp the film webbing prior to filling thereof, said downstream film clamping means being movable longitudinally with respect to the film webbing positioned within said loading station between a pre-loading position and a loading position, said loading position being located upstream with respect to said pre-loading position to provide sufficient slack in the film webbing between said downstream film clamping means and said upstream film clamping means to allow the first top pouch edge and the second top pouch edge to separate to open the top pouch opening therebetween and allow loading of the packaging;

3. a first pouch opening means fixedly secured with respect said housing means and oriented at an oblique angle extending laterally outwardly and upstream with respect to the film webbing located within said loading station, said first pouch opening means including a first gripping means adapted to grip the first top pouch edge of the film webbing prior to filling thereof, said first pouch opening means being movable between a first closed position adjacent the film webbing and a first opened position spatially disposed with respect to said film webbing in a lateral and upstream direction, said first pouch opening means being responsive to being in said first closed position for said first gripping means to grip the first top pouch edge of the film webbing with first top pouch edge and the second top pouch edge being adjacent and the top pouch opening therebetween being closed, said first pouch opening means being responsive to movement to said first opened position for said first gripping means to maintain grip of the first top edge of the film webbing and move the first top edge of the film webbing away from the second top edge of the film webbing for opening of the top pouch opening thereof to facilitate loading therethrough;

4. a second pouch opening means fixedly secured with respect said housing means on the opposite side of the film webbing with respect to said first pouch opening means, said second pouch opening means being oriented at an oblique angle extending laterally outwardly and upstream with respect to the film webbing located within said loading station, said second pouch opening means including a second gripping means adapted to grip the second top pouch edge of the film webbing prior to filling thereof, said second pouch opening means being movable between a second closed position adjacent the film webbing and a second opened position spatially disposed with respect to said film webbing in a lateral and upstream direction, said second pouch opening means being responsive to being in said second closed position for said second gripping means to grip the second top pouch edge of the film webbing with first top pouch edge and the second top pouch edge being adjacent and the top pouch opening therebetween being closed, said second pouch opening means being responsive to movement to said second opened position for said second gripping means to maintain grip of the second top edge of the film webbing and move the second top edge of the film webbing away from the first top edge of the film webbing for opening of the top pouch opening thereof to facilitate loading therethrough;

5. a filling means positioned above said first pouch opening means and said second pouch opening means adapted to supply materials to be filled downwardly to pass into the packaging through the top pouch opening thereof;

h. a sealing means adapted to seal the first top pouch edge with respect to the second top pouch edge and seal the top pouch opening after filling thereof;

i. a cutting means adapted to cut the formed package from the film webbing material after sealing of the top pouch opening thereof; and j. a discharge means adapted to expel the finally formed package from said housing means.

2. An apparatus for automatically forming, filling, sealing and separating film packaging from a film webbing as defined in claim 1 further including a film drive means operationally connected with respect to said film supply means to power supplying of film webbing therefrom.

3. An apparatus for automatically forming, filling, sealing and separating film packaging from a film webbing as defined in claim 1 wherein said film supply means comprises a film supply roller of tubular film webbing with the rotational axis thereof oriented vertically with respect to said housing means.

4. An apparatus for automatically forming, filling, sealing and separating film packaging from a film sheeting as defined in claim 1 wherein said film supply means comprises a film supply roller of film webbing with the rotational axis thereof oriented horizontally with respect to said housing means to facilitate movement of the film webbing onto said longitudinal support bar.

5. An apparatus for automatically forming, filling, sealing and separating film packaging from a film webbing as defined in claim 4 further comprising a folding means adapted to fold the horizontally extending film webbing down vertically along each vertically extending side of said longitudinal support bar.

6. An apparatus for automatically forming, filling, sealing and separating film packaging from a film webbing as defined in claim 1 further comprising:

a. a resealable zipper supply means positioned adjacent said upstream end of said housing means being adapted to supply a resealable zipper material for attachment with respect to the film webbing; and b. a zipper attachment means positioned below said longitudinal support bar and adapted to seal resealable zipper material with respect to the film webbing supported upon said longitudinal support bar.

7. An apparatus for automatically forming, filling, sealing and separating film packaging from a film webbing as defined in claim 6 wherein said resealable zipper supply means includes a zipper supply roller of resealable zipper material with the rotational axis thereof oriented horizontally with respect to said housing means to facilitate movement of the zipper material to said zipper attachment means.

8. An apparatus for automatically forming, filling, sealing and separating film packaging from a film webbing as defined in claim 6 further comprising a zipper drive means operationally connected with respect to said resealable zipper supply means to power supplying of resealable zipper material to said zipper attachment means.

9. An apparatus for automatically forming, filling, sealing and separating film packaging from a film webbing as defined in claim 1 further comprising guide roller means positioned adjacent said upstream end of said housing means and adapted to receive the film webbing from the film supply means for guiding delivery thereof onto said longitudinal support bar.

10. An apparatus for automatically forming, filling, sealing and separating film packaging from a film webbing as defined in claim 1 wherein the film webbing includes a resealable zipper means sealed thereto and further comprising a tracking roller means positioned below said longitudinal support bar to facilitate guiding and retaining of the film webbing upon said longitudinal support bar.

11. An apparatus for automatically forming, filling, sealing and separating film packaging from a film webbing as defined in claim 1 wherein said side sealing means is adapted to form a side seal in the film web at least ½ inch in width.

12. An apparatus for automatically forming, filling, sealing and separating film packaging from a film webbing as defined in claim 1 wherein said side sealing means and said side cutting means are both located at a single side sealing and side cutting station.

13. An apparatus for automatically forming, filling, sealing and separating film packaging from a film webbing as defined in claim 1 wherein said sealing means and said cutting means are located immediately below said loading station.

14. An apparatus for automatically forming, filling, sealing and separating film packaging from a film webbing as defined in claim 1 wherein said side sealing means is adapted to grip the film webbing and is longitudinally movable between a first sealing position and a second sealing position, said first sealing position being upstream with respect to said second sealing position, said side sealing means adapted to grip the film webbing at said first sealing position and move to said second sealing position to facilitate movement of the film webbing through said housing means.

15. An apparatus for automatically forming, filling, sealing and separating film packaging from a film webbing as defined in claim 1 wherein said upstream film clamping means and said downstream film clamping means are pneumatically powered.

16. An apparatus for automatically forming, filling, sealing and separating film packaging from a film webbing as defined in claim 1 wherein said first gripping means of said first pouch opening means and said second gripping means of said second pouch opening means are pneumatically powered.

17. An apparatus for automatically forming, filling, sealing and separating film packaging from a film webbing as defined in claim 1 wherein said first pouch opening means is responsive upon moving from said first closed position to said first opened position to move through an upstream distance component approximately equal to one-half of the upstream distance through which said downstream film clamping means moves responsive to moving thereof from said pre-loading position to said loading position.

18. An apparatus for automatically forming, filling, sealing and separating film packaging from a film webbing as defined in claim 1 wherein said second pouch opening means is responsive upon moving from said second closed position to said second opened position to move through an upstream distance component approximately equal to one-half of the upstream distance through which said downstream film clamping means moves responsive to moving thereof from said pre-loading position to said loading position.

19. An apparatus for automatically forming, filling, sealing and separating film packaging from a tubular film webbing comprising:

a. a housing means including an upstream end thereof for receiving of the film webbing and a downstream end thereof;

b. a film supply means positioned adjacent said upstream end of said housing means for providing a continuous supply of tubular film webbing thereto, said film supply means including a film supply roller of tubular film webbing with the rotational axis thereof oriented vertically with respect to said housing means, the tubular webbing including a resealable zipper means sealed thereto;

c. a film drive means operationally connected with respect to said film supply means to power supplying of film webbing therefrom;

d. a longitudinal support bar mounted with respect to said housing means and adapted to receive tubular film webbing from said film supply means for support thereon in a vertically extending orientation with the tubular film webbing surrounding said longitudinal support bar, said longitudinal support bar adapted to abut the film webbing at an intermediate position thereunder and allow portions of the film webbing to extend downwardly on both sides of said longitudinal support bar;

e. a guide roller means positioned adjacent said upstream end of said housing means and adapted to receive the film webbing from the film supply means for guiding delivery thereof onto said longitudinal support bar;

f. a tracking roller means positioned below said longitudinal support bar and adapted to receive and register the resealable zipper means therein to facilitate guiding and retaining of the film webbing upon said longitudinal support bar;

g. a side sealing means and side cutting means adapted to grip the film webbing and to form vertically extending side seals therein and to vertically cut the film webbing adjacent the side seals formed therein, said side sealing means and side cutting means being adapted to grip the film webbing and being longitudinally movable between a first sealing position and a second sealing position, said first sealing position being upstream with respect to said second sealing position, said side sealing means and side cutting means being adapted to grip the film webbing at said first sealing position and move to said second sealing position to facilitate movement of the film webbing through said housing means;

h. a top slitting means adapted to cut an opening in the film webbing adjacent the top edge thereof to form a first top pouch edge and second pouch edge and a top pouch opening therebetween for each individual packaging;

i. a loading station adapted to fill the packaging comprising:

1. an upstream film clamping means being pneumatically powered and adapted to clamp the film webbing prior to filling thereof;

2. a downstream film clamping means being pneumatically powered and located downstream with respect to said upstream film clamping means and adapted to clamp the film webbing prior to filling thereof, said downstream film clamping means being movable longitudinally with respect to the film webbing positioned within said loading station between a pre-loading position and a loading position, said loading position being located upstream with respect to said pre loading position to provide sufficient slack in the film webbing between said downstream film clamping means and said upstream film clamping means to allow the first top pouch edge and the second top pouch edge to separate to open the top pouch opening therebetween and allow loading of the packaging;

3. a first pouch opening means fixedly secured with respect said housing means and oriented at an oblique angle extending laterally outwardly and upstream with respect to the film webbing located within said loading station, said first pouch opening means including a first gripping means adapted to grip the first top pouch edge of the film webbing prior to filling thereof, said first gripping means being pneumatically powered, said first pouch opening means being movable between a first closed position adjacent the film webbing and a first opened position spatially disposed with respect to said film webbing in a lateral and upstream direction, said first pouch opening means being responsive to being in said first closed position for said first gripping means to grip the first top pouch edge of the film webbing with first top pouch edge and the second top pouch edge being adjacent and the top pouch opening therebetween being closed, said first pouch opening means being responsive to movement to said first opened position for said first gripping means to maintain grip of the first top edge of the film webbing and move the first top edge of the film webbing away from the second top edge of the film webbing for opening of the top pouch opening thereof to facilitate loading therethrough, said first pouch opening means being responsive upon moving from said first closed position to said first opened position to move through an upstream distance component approximately equal to one-half of the upstream distance through which said downstream film clamping means moves responsive to moving thereof from said pre-loading position to said loading position;

4. a second pouch opening means fixedly secured with respect said housing means on the opposite side of the film webbing with respect to said first pouch opening means, said second pouch opening means being oriented at an oblique angle extending laterally outwardly and upstream with respect to the film webbing located within said loading station, said second pouch opening means including a second gripping means adapted to grip the second top pouch edge of the film webbing prior to filling thereof, said second gripping means being pneumatically powered, said second pouch opening means being movable between a second closed position adjacent the film webbing and a second opened position spatially disposed with respect to said film webbing in a lateral and upstream direction, said second pouch opening means being responsive to being in said second closed position for said second gripping means to grip the second top pouch edge of the film webbing with first top pouch edge and the second top pouch edge being adjacent and the top pouch opening therebetween being closed, said second pouch opening means being responsive to movement to said second opened position for said second gripping means to maintain grip of the second top edge of the film webbing and move the second top edge of the film webbing away from the first top edge of the film webbing for opening of the top pouch opening thereof to facilitate loading therethrough, said second pouch opening means being responsive upon moving from said second closed position to said second opened position to move through an upstream distance component approximately equal to one-half of the upstream distance through which said downstream film clamping means moves responsive to moving thereof from said pre-loading position to said loading position;

5. a filling means positioned above said first pouch opening means and said second pouch opening means adapted to supply materials to be filled downwardly to pass into the packaging through the top pouch opening thereof;

j. a sealing means adapted to seal the first top pouch edge with respect to the second top pouch edge and seal the top pouch opening after filling thereof, said sealing means being located immediately below said loading station;

k. a cutting means adapted to cut the formed package from the film webbing material after sealing of the top pouch opening thereof, said cutting means being located immediately below said loading station; and l. a discharge means adapted to expel the finally formed package from said housing means, said discharge means being located adjacent said loading station.

20. An apparatus for automatically forming, filling, sealing and separating film packaging from a film webbing comprising:

a. a housing means including an upstream end thereof for receiving of the film webbing and a downstream end thereof;

b. a film supply means positioned adjacent said upstream end of said housing means for providing a continuous supply of film webbing thereto, said film supply means including a film supply roller of film webbing with the rotational axis thereof oriented in a horizontal direction with respect to said housing means to facilitate movement of the film webbing into the upstream end of said housing means;

c. a film drive means operationally connected with respect to said film supply means to power supplying of film webbing therefrom;

d. a longitudinal support bar mounted with respect to said housing means and adapted to receive film webbing from said film supply means for support thereon in a vertically extending orientation, said longitudinal support bar adapted to abut the film webbing at an intermediate position thereunder and allow portions of the film webbing to extend downwardly on both sides of said longitudinal support bar;

e. a guide roller means positioned adjacent said upstream end of said housing means and adapted to receive the film webbing from the film supply means for guiding delivery thereof onto said longitudinal support bar;

f. a folding means positioned between said guide roller means and said longitudinal support bar and being adapted to fold the horizontally extending film webbing down vertically along each vertically extending side of said longitudinal support bar;

g. a resealable zipper supply means positioned adjacent said upstream end of said housing means being adapted to supply a resealable zipper material for attachment with respect to the film webbing, said resealable zipper supply means including a zipper supply roller of resealable zipper material with the rotational axis thereof oriented horizontally with respect to said housing means to facilitate movement of the zipper material to a position adjacent the film web material;

h. a zipper attachment means positioned below said longitudinal support bar and adapted to seal resealable zipper material with respect to the film webbing supported upon said longitudinal support bar;

i. a zipper drive means operationally connected with respect to said resealable zipper supply means to power supplying of resealable zipper material to said zipper attachment means;

j. a side sealing means adapted grip the film webbing and form vertically extending side seals therein, said side sealing means being adapted to grip the film webbing and being longitudinally movable between a first sealing position and a second sealing position, said first sealing position being upstream with respect to said second sealing position, said side sealing means being adapted to grip the film webbing at said first sealing position and move to said second sealing position to facilitate movement of the film webbing through said housing means;

k. a side cutting means for vertically cutting of the film webbing adjacent the side seals formed therein by said side sealing means;

l. a top slitting means adapted to cut an opening in the film webbing adjacent the top edge thereof to form a first top pouch edge and second pouch edge and a top pouch opening therebetween for each individual packaging;

m. a loading station adapted to fill the packaging comprising:

1. an upstream film clamping means being pneumatically powered and adapted to clamp the film webbing prior to filling thereof;

2. a downstream film clamping means being pneumatically powered and located downstream with respect to said upstream film clamping means and adapted to clamp the film webbing prior to filling thereof, said downstream film clamping means being movable longitudinally with respect to the film webbing positioned within said loading station between a pre-loading position and a loading position, said loading position being located upstream with respect to said pre-loading position to provide sufficient slack in the film webbing between said downstream film clamping means and said upstream film clamping means to allow the first top pouch edge and the second top pouch edge to separate to open the top pouch opening therebetween and allow loading of the packaging;

3. a first pouch opening means fixedly secured with respect said housing means and oriented at an oblique angle extending laterally outwardly and upstream with respect to the film webbing located within said loading station, said first pouch opening means including a first gripping means adapted to grip the first top pouch edge of the film webbing prior to filling thereof, said first gripping means being pneumatically powered, said first pouch opening means being movable between a first closed position adjacent the film webbing and a first opened position spatially disposed with respect to said film webbing in a lateral and upstream direction, said first pouch opening means being responsive to being in said first closed position for said first gripping means to grip the first top pouch edge of the film webbing with first top pouch edge and the second top pouch edge being adjacent and the top pouch opening therebetween being closed, said first pouch opening means being responsive to movement to said first opened position for said first gripping means to maintain grip of the first top edge of the film webbing and move the first top edge of the film webbing away from the second top edge of the film webbing for opening of the top pouch opening thereof to facilitate loading therethrough, said first pouch opening means being responsive upon moving from said first closed position to said first opened position to move through an upstream distance component approximately equal to one-half of the upstream distance through which said downstream film clamping means moves responsive to moving thereof from said pre-loading position to said loading position;

4. a second pouch opening means fixedly secured with respect said housing means on the opposite side of the film webbing with respect to said first pouch opening means, said second pouch opening means being oriented at an oblique angle extending laterally outwardly and upstream with respect to the film webbing located within said loading station, said second pouch opening means including a second gripping means adapted to grip the second top pouch edge of the film webbing prior to filling thereof, said second gripping means being pneumatically powered, said second pouch opening means being movable between a second closed position adjacent the film webbing and a second opened position spatially disposed with respect to said film webbing in a lateral and upstream direction, said second pouch opening means being responsive to being in said second closed position for said second gripping means to grip the second top pouch edge of the film webbing with first top pouch edge and the second top pouch edge being adjacent and the top pouch opening therebetween being closed, said second pouch opening means being responsive to movement to said second opened position for said second gripping means to maintain grip of the second top edge of the film webbing and move the second top edge of the film webbing away from the first top edge of the film webbing for opening of the top pouch opening thereof to facilitate loading therethrough, said second pouch opening means being responsive upon moving from said second closed position to said second opened position to move through an upstream distance component approximately equal to one-half of the upstream distance through which said downstream film clamping means moves responsive to moving thereof from said pre-loading position to said loading position;

5. a filling means positioned above said first pouch opening means and said second pouch opening means adapted to supply materials to be filled downwardly to pass into the packaging through the top pouch opening thereof;

n. a sealing means adapted to seal the first top pouch edge with respect to the second top pouch edge and seal the top pouch opening after filling thereof, said sealing means being located immediately below said loading station;

o. a cutting means adapted to cut the formed package from the film webbing material after sealing of the top pouch opening thereof, said cutting means being located immediately below said loading station; and p. a discharge means adapted to expel the finally formed package from said housing means, said discharge means being located adjacent said loading station.

* * * * *